US005282945A

United States Patent [19]

Riscke et al.

[11] Patent Number: 5,282,945

[45] Date of Patent: Feb. 1, 1994

[54] DEVICE FOR APPLYING DOT-SHAPED COATINGS

[75] Inventors: Jörg W. Riscke, Veldhoven; Wilhelmus G. Leonardus Van Sprang, Eindhoven, both of Netherlands

[73] Assignee: Meco Equipment Engineers B.V., Hertogenbosch, Netherlands

[21] Appl. No.: 855,548

[22] Filed: Mar. 20, 1992

[30] Foreign Application Priority Data

Apr. 12, 1991 [NL] Netherlands ..... 9100640

[51] Int. Cl.[5] ..... C25D 17/00; B05B 15/04

[52] U.S. Cl. ..... 204/206; 204/224 R; 118/301

[58] Field of Search ..... 204/224 R, 206; 118/301

[56] References Cited

U.S. PATENT DOCUMENTS

| | | | |
|---|---|---|---|
| 3,894,918 | 7/1975 | Corby et al. | 204/224 R X |
| 4,405,431 | 9/1983 | Pfeifer et al. | 204/224 R X |
| 4,414,075 | 11/1983 | Cockeran | 204/206 X |
| 4,493,757 | 1/1985 | Piepers | 204/206 |

FOREIGN PATENT DOCUMENTS 2117404 10/1983 United Kingdom .

*Primary Examiner*—Donald R. Valentine

*Attorney, Agent, or Firm*—Oblon, Spivak, McClelland, Maier & Neustadt

[57] ABSTRACT

The invention relates to a device for applying dot-shaped coatings to metal or metallized bands by way of an electrolysis process or by way of currentless metal extraction, said device being provided with a wheel-shaped guide mechanism along which a metal or metallized band can be passed, and with an endless masking device, which co-operates with the band during operation and which is provided with passages, whose shape is adapted to the desired dot-shaped coating. The masking device is built up of independent masking segments, which are each provided with at least one passage and which are mutually coupled in such a manner that they can move with respect to each other in the longitudinal direction of the masking device. Inner boundary planes of the masking segments cooperate with a circular supporting surface of the wheel-shaped means, and measured in the longitudinal direction of the masking device the total length of the inner boundary faces is larger than the length of the circular supporting surface of the wheel-shaped means.

10 Claims, 7 Drawing Sheets

DEVICE FOR APPLYING DOT-SHAPED COATINGS

The invention relates to a device for applying dot-shaped coatings to metal or metallized bands by means of an electrolysis process or by means of currentless metal extraction. The device being provided A with a wheel-shaped guide means, along which a metal or metallized band can be passed, and with an endless masking means, which co-operates with the band during operation and which is provided with passages, whose shape is adapted to the desired dot-shaped coating. The masking means being built up of independent masking segments, which are each provided with at least one passage and which are mutually coupled in such a way that they can move with respect to each other in the longitudinal direction of the masking means, while each masking segment is provided with a pin, which during operation engages a recess provided in the band, and inner boundary planes of the masking segments, which are located at the sides of the masking segments remote from the outer boundary planes supporting the band during operation, co-operate with a circular supporting surface of the wheel-shaped means.

Such a device is known from European Patent No. 0,060,591.

Such a device is used for the processing of basic components required in large quantities in the electronics industry, such as supporting elements cut from metal, to be used in the production of transistors, integrated circuits and the like, or parts used in the production of contact systems, switch elements and the like, as well as etched metal patterns on a carrying foil of plastic material. Generally a a precious metal coating, such as gold, palladium or silver must be applied to these basic components, on the one hand for mounting purposes and on the other hand so as to obtain particularly reliable contact systems. Such coatings can usually be limited to certain functional parts of the basic components. The coating with a precious metal, using a device of the above kind, takes place by passing the basic components, which are etched or cut from long bands, through the above device with the basic components still being interconnected in the bands in question, whereby the band is uncoiled from a reel arranged on one side of the device, passed through the device and then re-coiled on another reel.

The development in the electronics industry is thereby directed at the use of increasingly smaller and lighter basic components in more and more complicated patterns. This development has led to the use of metal bands having a thickness of 0.075–0.125 mm, instead of the metal bands having a thickness of 0.25–0.40 mm that have been usual so far, for the production of cut-out basic components or carrying elements for the manufacture of integrated circuits. In addition to that, bands made of a plastic material, usually polyamid, and having a thickness of 0.015–0.150 mm are presently being used, with metal coatings, usually copper, applied thereon in a thickness of ±0.035 mm, whereby the desired pattern of the basic components are provided in the metal coating by means of a photochemical etching process.

It will be apparent that such metal or metallized bands are particularly vulnerable and that on the one hand heavy demands are made on the devices for processing such bands, so as to avoid damage to the bands, and that on the other hand heavy demands are made on the accuracy with which the dot-shaped coatings are applied, in such a manner that these coatings are applied with great precision in the desired places on the basic components, with a minimum amount of coating material being used.

The device according to the aforesaid European Patent No. 0,060,591 is satisfactory per se, both as regards the care with which the bands are treated and as regards the precision with which the dot-shaped coatings are applied. Thus the deviation in the mutual distance between dot-shaped coatings, measured in the longitudinal direction of the band, does not exceed ±0.15 mm when expert use is made of this known device.

The object of the invention is to achieve an even greater dimensional accuracy, as a result of which it becomes possible to realize a further saving of coating material and/or use more complex patterns for the basic components, while the dot-shaped coatings are still applied at the correct locations.

According to the invention this can be achieved in that, measured in the longitudinal direction of the masking means, the total length of the inner boundary faces of the masking segments constituting the masking means, which boundary faces co-operate with the circular supporting surface of the wheel-shaped means, is larger than the length of the circular supporting surface of the wheel-shaped means.

When using the construction according to the invention those masking segments that during operation are not retained between the band to be processed and the circular supporting surface of the wheel-shaped means, are spaced from the circular supporting surface by some distance, this in contrast to the construction used in European Patent No. 0,060,591, wherein the masking means surrounds the wheel-shaped means comparatively closely and wherein the masking segments are at all times supported on the circular supporting surface of the wheel-shaped means.

When using the construction according to the invention it is possible, at the point where the band first makes contact with the wheel-shaped means and where a pin of a masking segment also arriving at this point engages a relevant recess in the band, for the masking segment in question to adjust itself freely with respect to the band, without being impeded by masking segments coming behind the masking segment, when seen in the direction of movement of the masking segment.

It has become apparent that when the construction according to the invention is used, it is possible, even for very thin and vulnerable long bands, to be passed through the device in a continuous way, without any risk of damage being done to the basic components formed in the bands, while it is at the same time avoided, due to the free adjustability of the masking segments in the point where the masking segments first make contact with the band to be processed, that tolerance differences accumulate. By preventing the accumulation of tolerance differences is has become possible to reduce the amount of play between the parts of the pins on the masking segments coming into contact with each other and the recesses provided in the band in comparison with the amount of play used with the conventional devices. Surprisingly it has become apparent that the variations in the distances of successive dot-shaped coatings, when measured in the longitudinal direction of the belt, can thereby be limited to ±0.075 mm or less without any problem.

It is noted that from U.S. Pat. No. 4,414,075 a device is known for applying dot-shaped coatings to a metal band or the like, wherein use is made of an endless masking means, which is built up of pivotally coupled masking segments. To each segment a masking cover is pivotally coupled, in such a manner that the masking cover is pivotable between a non-operative position and an operative position, in which the band is clamped between the masking cover and the associated masking segment.

When using this known device the masking segments and the masking covers coupled thereto, between which part of the band is, are guided between spaced-apart straight stationary guide means pushing the masking segments and the masking covers towards each other. Thereby the clamped part of the band is passed along a straight path through an electrolysis station, electrolyte being jetted against the band in the electrolysis station for forming the desired dot-shaped coatings on the band.

The construction of this known device is complicated and costly, while a comparatively great deal of force will be required for displacing the masking means and the band, in particular in connection with the movement of the clamped-together masking segments and masking covers between the guide means arranged near the electrolysis station. In U.S. Pat. No. 4,414,075 it is thereby proposed to drive the masking means when vulnerable bands are being processed. When the masking means are driven it will be impossible to avoid, however, that the masking segments, which have initially taken up a certain position with respect to the band upon the first contact of the band with the masking segments, will move with respect to each other in the longitudinal direction of the masking means, as a result of which deformations of the band or of the basic components, in particular with thin bands and/or bands with basic components having a complex cutting pattern, cannot be avoided, and it will thus be impossible to realize the intended application of dot-shaped coatings within narrow tolerances.

BRIEF DESCRIPTION OF THE DRAWINGS

The invention will be further explained hereafter with reference to the accompanying Figures.

DESCRIPTION OF THE PREFERRED EMBODIMENTS

Figure 1:
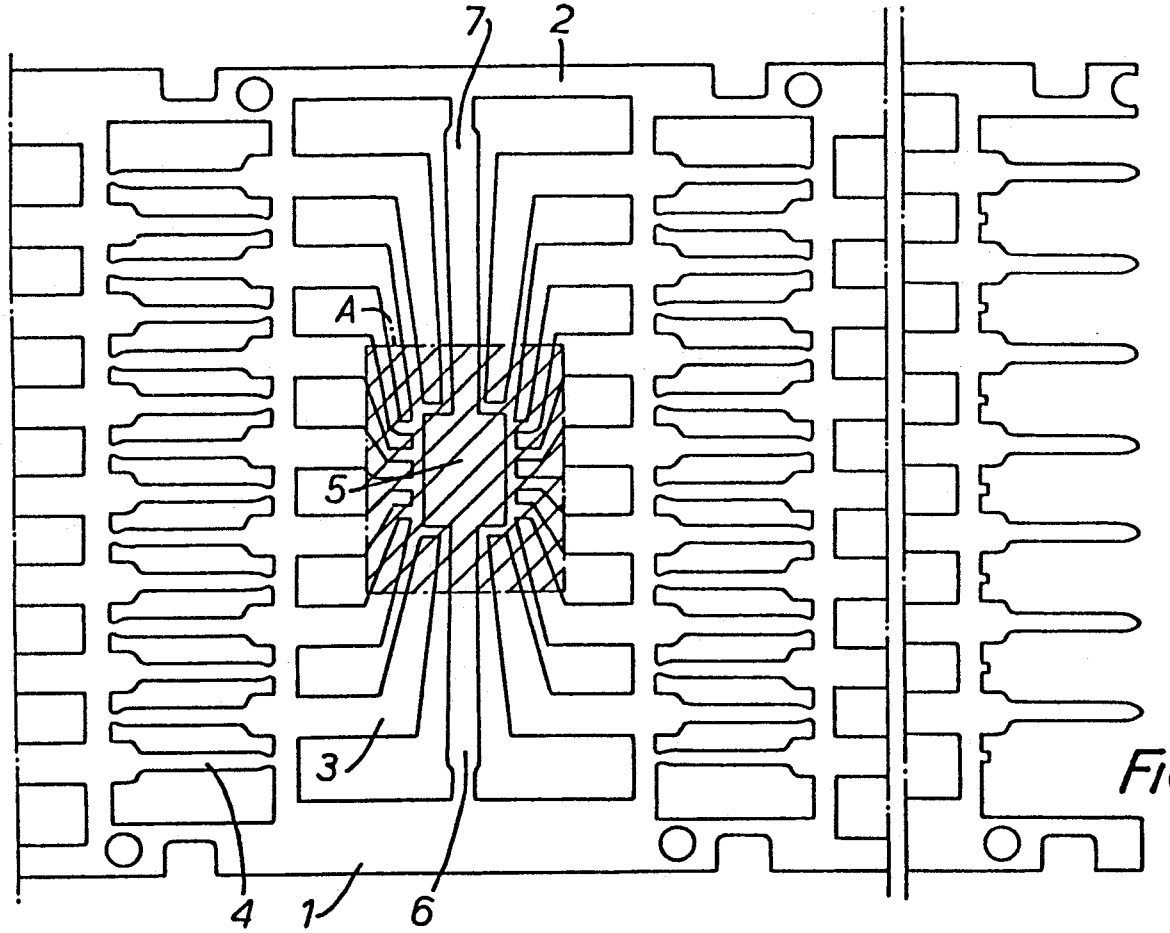
FIG. 1 diagrammatically shows a part of a band consisting of a number of basic components, to which dot-shaped coatings can be applied by means of the device according to the invention.

As is illustrated in FIG. 1 a metal or metallized band, which is to be locally provided with dot-shaped coatings, may be a band which is cut out, or whose metal coating applied to a band of plastic material is shaped in such a manner that the band is provided with two edge parts 1 and 2 extending in the longitudinal direction of the band, with fingershaped parts 3 and 4 located therebetween and being connected thereto, and with a rectangular part 5 surrounded by the free ends of the fingershaped parts 3, the rectangular part 5 being connected to the edge parts 1 and 2 by means of connecting strips 6 and 7. The parts 3–7 thereby form a basic product which, together with a large number of corresponding basic products, is shaped in such a manner that the basic products are interconnected by means of the edge parts 1 and 2 so as to form a band, which may furthermore be subjected to one or more processing steps, e.g. be passed through the device to be described hereafter in order for dot-shaped coatings to be applied thereon. Such dot-shaped coatings must generally be applied to the part of each basic product indicated by the hatched area A in FIG. 1.

Figure 2:
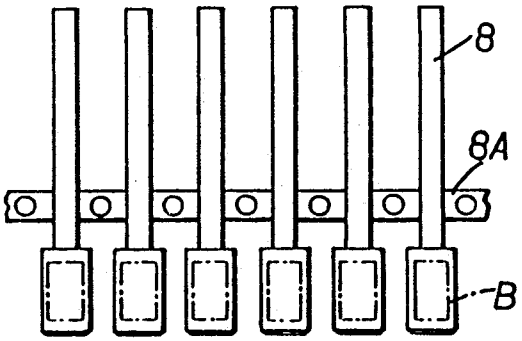
FIG. 2 shows a second embodiment of a part of a band, which can be processed by means of the device according to the invention.

A further example of a product which may be processed by means of the device according to the invention is shown is FIG. 2. As is illustrated the basic products formed by contact pins 8 are hereby interconnected by means of a band-shaped means 8A, so as to form an elongated band. When such a band is passed through the device according to the invention dot-shaped coatings are to be applied to the basic products 8 in the areas B indicated by chain-dotted lines.

In principle the application of such dot-shaped coatings by means of an electrolysis process is known, e.g. from the aforesaid European Patent No. 0,060,591 or Dutch Patent No. 150,860.

The device according to the invention shown in FIGS. 3–7 comprises a wheel-shaped means 9, which is freely rotatable about its axis 10 during operation. The wheel-shaped means is thereby built up of two spaced-apart wheel-rings 11 and 12. Said wheel-rings 11 and 12 are supported in a frame (not shown) by means of three regularly spaced supporting rollers 13 (FIG. 4) disposed around the axis of rotation 10 of the wheel-shaped means 9 and being journalled in the frame. For easy reference the supporting rollers 13 are not shown in FIG. 3.

Figure 4:
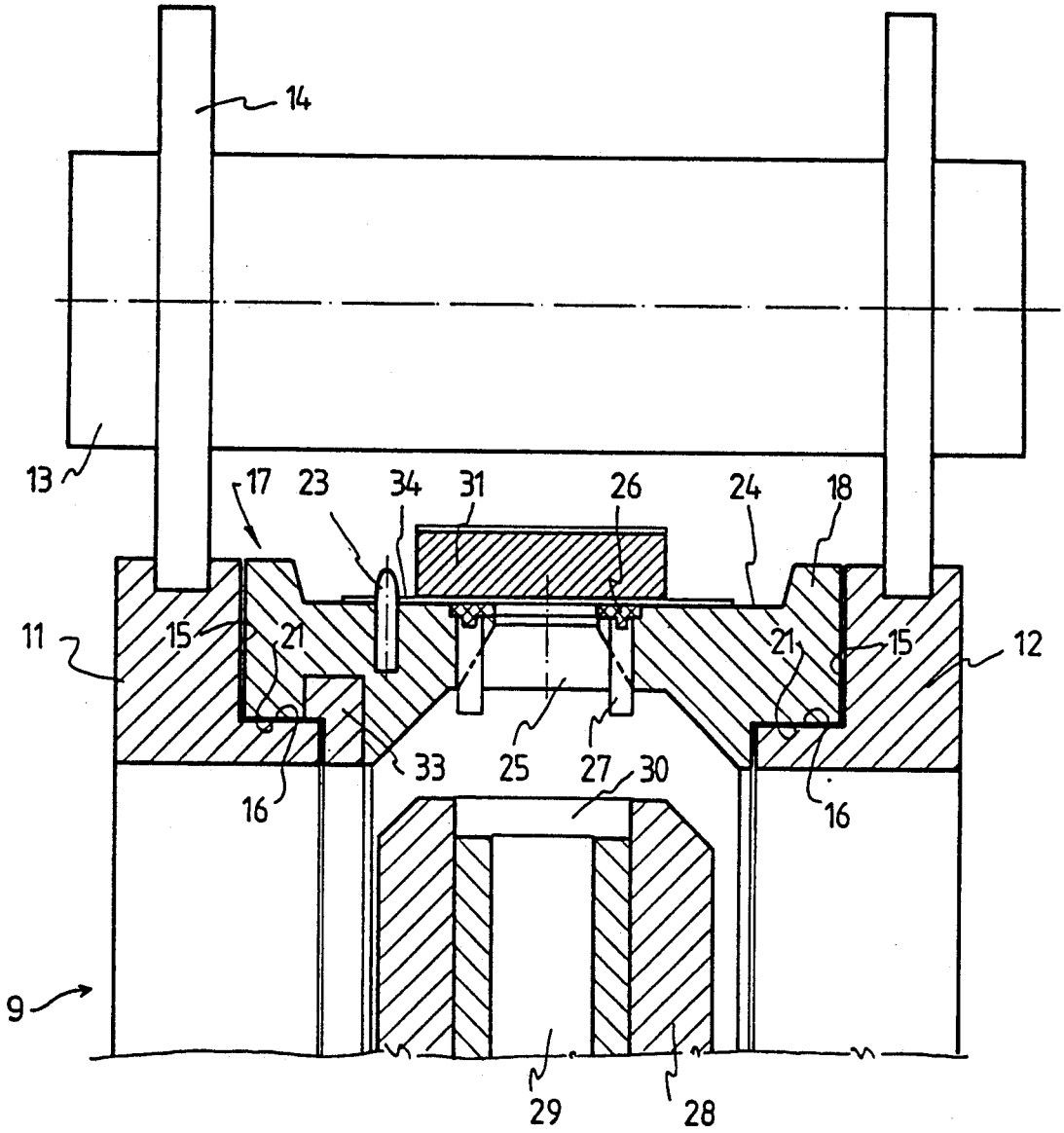
FIG. 4 is a larger-scale cross-sectional view of a part of the wheel-shaped means according to FIG. 3 and a supporting roller for the wheel-shaped means.

At is apparent from FIG. 4 the supporting rollers 13 are provided with protruding collars 14, which run in grooves provided circumferentially in the wheel-rings 11 and 12.

Circular recesses are provided in the wheel-rings 11, at the facing sides of the wheel-rings, the recesses being bounded by boundary faces 15 extending perpendicularly to the axis of rotation 10 and by boundary faces 16 extending concentrically about the axis of rotation 10.

An endless masking means 17 is passed over the wheel, the masking means being built up of a number of interconnected masking segments 18.

Figure 5:
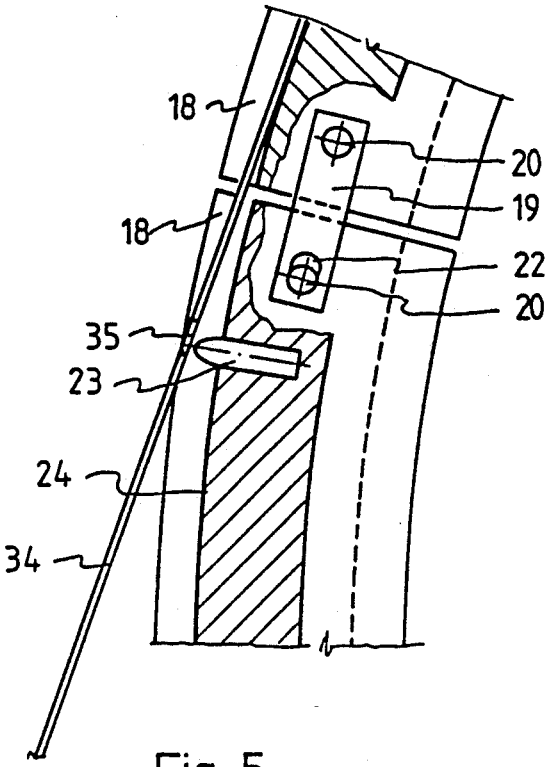
FIG. 5 is a view, partially in side elevation and partially in section, of a part of the wheel-shaped means with a band making contact with the wheel-shaped means.
Figure 6:
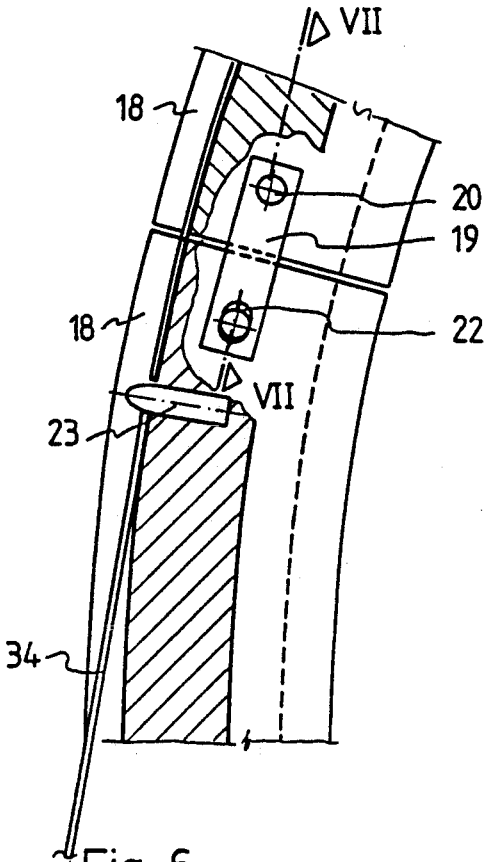
FIG. 6 is a view corresponding with FIG. 5, whereby the wheel-shaped means is rotated a little further with respect to the position shown in FIG. 5.
Figure 7:
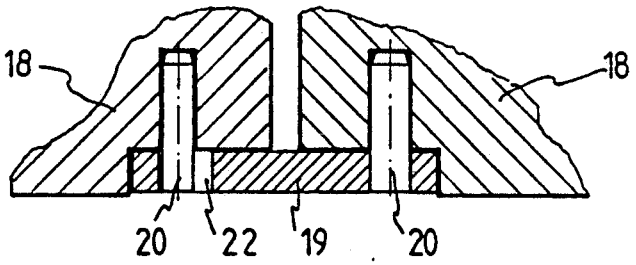
FIG. 7 is a sectional view of a part of FIG. 6, along the line VII—VII in FIG. 6.

The successive masking segments 18 are interconnected by means of connecting plates 19, which are pivotally coupled to the masking segments 18 by means of pins 20 extending parallel to the axis of rotation 10 (FIGS. 5-7).

The masking segments have inner boundary faces 21, with a radius of curvature equal to the radius of curvature of the boundary faces 16, which form supporting surfaces for the masking segments 18.

The total length, measured in circumferential direction, of the inner boundary faces 21 of the masking segments 18 forming part of the endless masking means 17 is larger than the length, measured in circumferential direction, of a supporting surface 16. Accordingly, as is shown in particular in FIG. 3, the inner boundary faces 21 of a part of the masking segments 18 will be spaced from the relevant supporting surfaces 16 of the two wheel-rings 11 and 12, so that the masking segments present in the lower part of the endless masking means, when seen in FIG. 3, can move freely with respect to each other in the longitudinal direction of the band. This free movement of the masking segments 18 with respect to each other is made possible because, as is shown in FIGS. 5 and 6, one of the holes 22 provided in a connecting plate 19, through which a pin 20 is passed, is a slotted hole.

As furthermore appears from FIGS. 5 and 6 each masking segment is provided with a radially extending pin 23, which projects from the masking segment near an outer boundary face 24 and which tapers off towards the outside.

Each masking means has a passage 25, the passage near the outer boundary face 24 being surrounded by an insert 26 of a soft resilient material, the insert being received in a correspondingly shaped recess provided in the outer boundary face. The insert 26 has projections 27 integral therewith, the projections being inserted into bores provided in the masking segment in question so as to anchor the insert 26.

A housing 28 is arranged between the two wheel-rings 11 and 12, the housing defining a chamber 29, to which a pressurized electrolyte is supplied during operation of the device. Near the upper side of the housing 28 a plurality of longitudinal slits 30 are provided in a circumferential wall of the housing bounding the chamber 29, the slits extending parallel to the axis of rotation 10 and allowing the pressurized electrolyte to squirt out in the direction of the masking segments 18 resting on the upper part of the wheel-shaped means 9.

Figure 3:
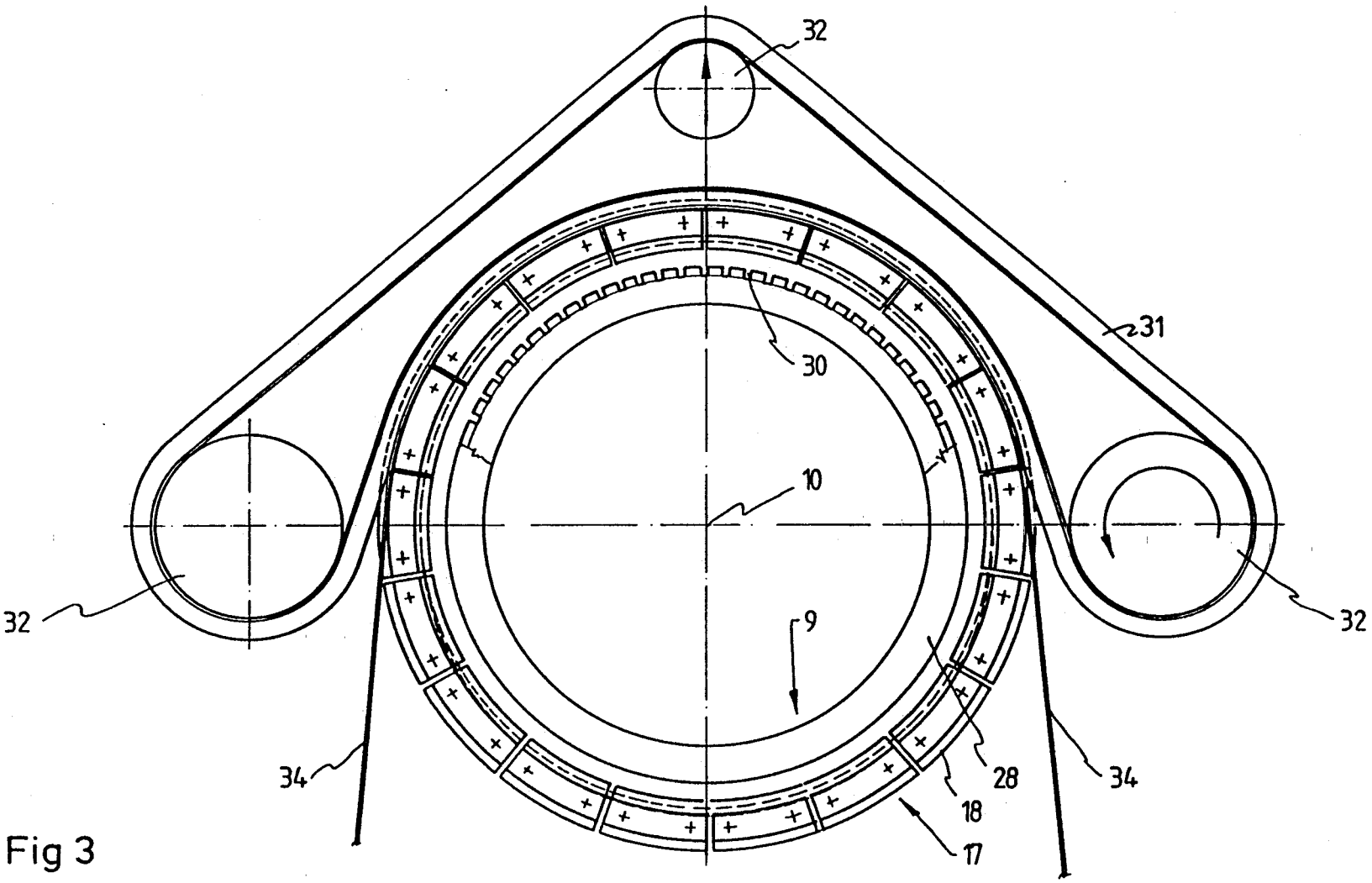
FIG. 3 is a diagrammatic view of a wheel-shaped means of the device according to the invention, with an endless masking means provided around the wheel-shaped means.

The masking segments 18 resting on the upper part of the wheel-shaped means 9 co-operate with an endless hold-down or masking band 31 which, as shown in FIG. 3, is passed over three guide wheels 32 in such a way that the band 32 abuts against the outside of the masking segments 18 resting on the upper part of the wheel-shaped means 9 along a circumferential angle of e.g. 150°-160°.

As is furthermore illustrated in FIG. 4 a ring 33 having an L-shaped section and being supported by the wheel-ring 11 is provided at the inner the of the wheel-ring 11, the ring 33 being received in correspondingly shaped recesses formed at the inner circumference of the masking segments. This ring contributes towards well-positioning of the masking segments as well as preventing the undesirable tilting of the masking segments.

During operation a band 34, e.g. built up of the above-described basic components illustrated in the FIGS. 1 and 2, will be passed between the band 31 and the outer boundary faces 24 of the masking segments 18, in the manner shown in FIGS. 3-6. In general the band 34 is moved in its longitudinal direction by drive means (not shown).

When the band 34 makes contact with the wheel-shaped means the conical end of a pin 23 will gradually be inserted into a recess 35 provided in the band 34 for that purpose, as will be seen from FIGS. 5 and 6. The recesses 35 are thereby provided in the band 34 with a predetermined fixed pitch distance, which is adapted to the dimensions of the basic components to be treated and of the places where dot-shaped coatings are to be applied.

As will be seen from FIGS. 5 and 6 the end of the pin 23 will thereby be engaged by the rear, when seen in the direction of movement of the band 34, boundary edge of the recess 35, as a result of which the masking segment 18 in question will be caught by the band 34.

Since the masking segment 18 caught by the band can move within certain limits with respect to the preceding masking segment 18, in the longitudinal direction of the masking means formed by the masking segments, and such a movement is not impeded by the masking segments coming behind this caught segment and being freely connected to the segment, the masking segment 18 caught by the band can freely adjust itself with respect to the band, without exerting undesirable forces on the band thereby. As a result of this the hole 25 provided in the masking segment in question will be precisely located opposite the location on the band 34 where a dot-shaped coating is to be applied to the band 34.

Since the electrolyte squirts from the chamber through the slits 30 extending parallel to the axis of rotation 10 the electrolyte will be squirted into the passages 25 in a pulsate manner as it were, because the passages 25 are moved with respect to the slits 30 in the fixedly disposed chamber 28 during operation, as a result of which a very effective flushing of the passages 25 with fresh electrolyte is obtained during the movement of the passages 25 along the slitted part 30 of the housing 28, which contributes towards an efficient application of the intended dot-shaped coatings. The insert element 26 surrounding the passage 25 and the masking band 31 abutting against the outside of the band 34 thereby prevent the electrolyte from flowing along parts of the band in an undesirable manner.

As usual the band 34 thereby acts as a cathode, while the housing 28 comprises an anode.

Figure 10:
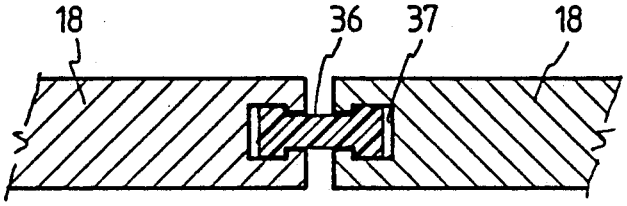
FIGS. 10–12 show various embodiments of sealing means provided between successive masking segments.

Of course sealing means must be present between the successive masking segments, as is also described in the aforesaid European Patent No. 0,060,591. Such a sealing means 36 may e.g. have an I-shaped cross-section, as is illustrated in FIG. 10, whereby the thickened ends are received with some play in correspondingly shaped recesses 37, which are provided in the facing sides of successive masking segments 18, which are indicated only diagrammatically in FIG. 10.

Figure 8:
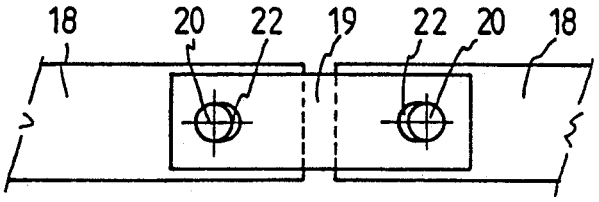
FIG. 8 diagrammatically shows a further embodiment of the means for coupling two successive masking segments.

Of course further variations and/or additions are conceivable within the spirit and scope of the invention. Thus, as is diagrammatically indicated in FIG. 8, the two holes 22 provided in the connecting plate may have an unround section, such that the two pins 20 are received in the holes 22 in question with some play.

Figure 9:
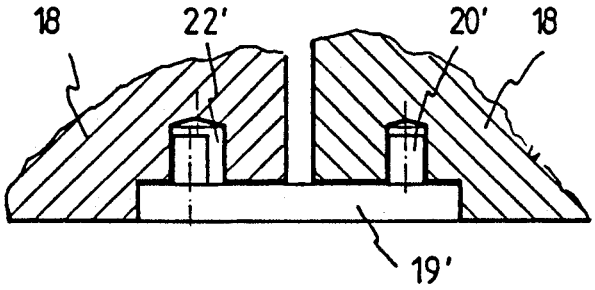
FIG. 9 is a sectional view of a further embodiment of the coupling between two masking segments.

FIG. 9 shows an embodiment wherein pins 20' are fixed to connecting pieces 19', while the pins 20' are received in holes 22' provided in the segments 18' in question, at least one of the holes having the shape of a slotted hole or the like.

Figure 11:
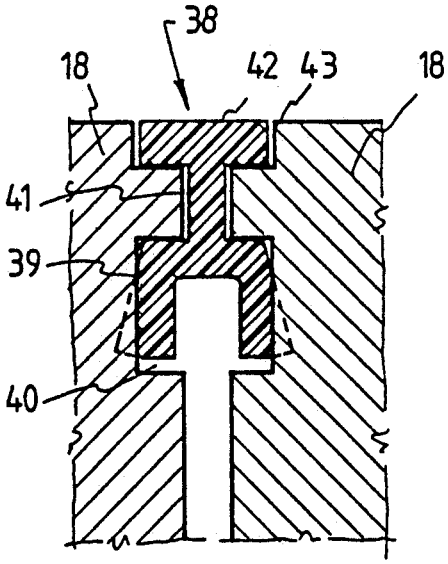

FIG. 11 shows a further possible embodiment of a sealing means 38 to be provided between two successive masking segments 18. The sealing means comprises a U-shaped part 39, whose legs extending parallel to each other are received in recesses 40 provided in the facing sides of the two segments 18. The U-shaped section is connected, by means of a connecting rib 41 extending between the two segments 18, to a web 42 extending perpendicularly to the legs of the U-shaped part 39, the ends of the web being received in recesses 43, which are provided in the facing sides of the segments 18.

The arrangement is thereby such that the free ends of the legs of the U-shaped part are directed towards the chamber 28, so that fluid squirted from the chamber 28 and flowing between the facing ends of the segments 18, in the direction according to the arrow A, will attempt to press the two legs of the U-shaped part outwards, as is diagrammatically indicated by means of dotted lines, so that an effective sealing is effected.

Figure 12:
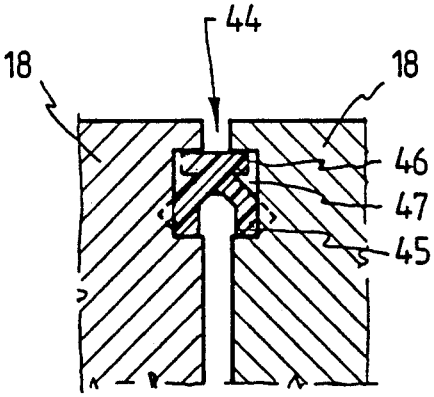

FIG. 12 shows a similar built-up construction of a sealing means 44, which is built up of a U-shaped part 45 and a web part 46 adjoining the U-shaped part. The sealing means 44 is thereby received in recesses 47 in the manner illustrated in FIG. 12, the recesses being provided in the facing sides of the masking segments 18. It will be seen that the operation of the sealing means corresponds with the operation of the sealing means 38 shown in FIG. 11.

Figure 14:
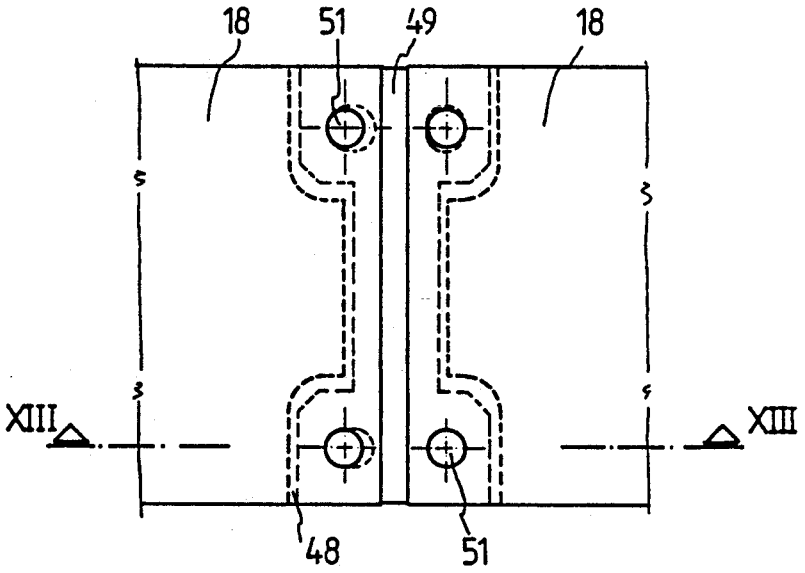
FIG. 14 is a plan view of FIG. 13.
Figure 13:
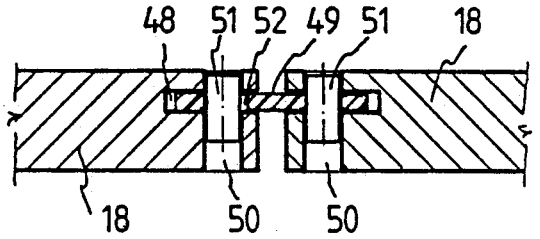
FIG. 13 shows an embodiment, wherein a sealing means provided between two successive masking segments is also used for coupling the masking segments in question.

In the embodiment illustrated in FIGS. 13 and 14 slotted holes 48 are provided in the facing sides of the diagrammatically indicated masking segments 18, the ends of a plate-shaped sealing means 49 being located in the slotted holes 48 in such a manner that said plate-shaped sealing means 49 bridges the gap between the facing ends of the masking segments 18 so as to close the gap. Furthermore holes 50 extending perpendicularly to the slots 48 are provided in the masking segments 18, the holes receiving pins 51, which pins also extend through holes 52 provided in the sealing means 49, at least a few of the holes 52 having a larger diameter than the pins 51 in question.

It will be seen that the sealing means 49 not only function to seal the gap between two successive masking segments 18 hereby, but also to movably couple the successive masking segments 18, thus replacing the above-described connecting plates 19.

Figure 15:
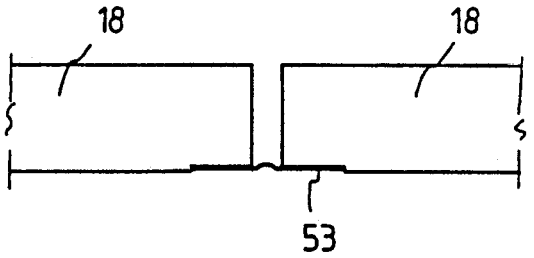
FIGS. 15–17 show further embodiments of the constructions, wherein sealing means provided between successive masking segments are also used for coupling the masking segments in question.
Figure 16:
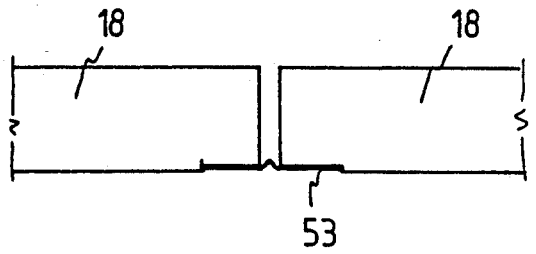

Another embodiment, wherein the sealing means between successive masking segments also functions to movably couple the masking segments is shown in FIGS. 15 and 16.

As is illustrated in FIGS. 15 and 16 recesses are provided at the inner sides of the diagrammatically depicted masking segments 18, near the facing ends, the recesses receiving and fixing the ends of a connecting plate 53 made of a flexible material. From FIGS. 15 and 16 it will be apparent that this connecting plate closes the passage between the facing ends of two neighboring masking segments 18 and at the same time interconnects the masking segments 18 in such a manner that these masking segments can move with respect to each other in the longitudinal direction of the masking means formed by the masking segments.

Figure 17:
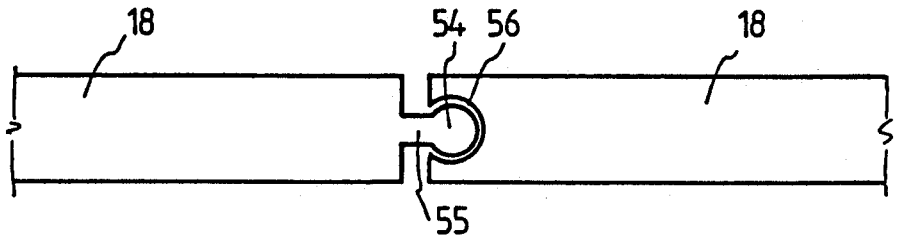

FIG. 17 diagrammatically illustrates an embodiment wherein a masking segment is at one end provided with a coupling rod 54 having an at least substantial circular section, the rod being connected to the remaining part of the masking segment 18 by means of a connecting neck 55 having a smaller diameter than the rod 54. The coupling rod 54 and the connecting neck thereby extend the entire width of the masking segment 18 in question. The coupling rod 54 is received in a recess 56 provided in an opposite end of a neighboring masking segment, the recess having such a diameter that the coupling piece can be accommodated with some play therein. It will be apparent that the coupling piece 54 with the connecting neck 55 closes the gap between successive masking segments 18, while the coupling piece 54, together with the recess 56 receiving the coupling piece, also takes care of the interconnection of successive masking segments 18, in such a manner that the masking segments 18 can move along a certain distance with respect to each other, in the longitudinal direction of the masking means formed by the masking segments.

Figure 19:
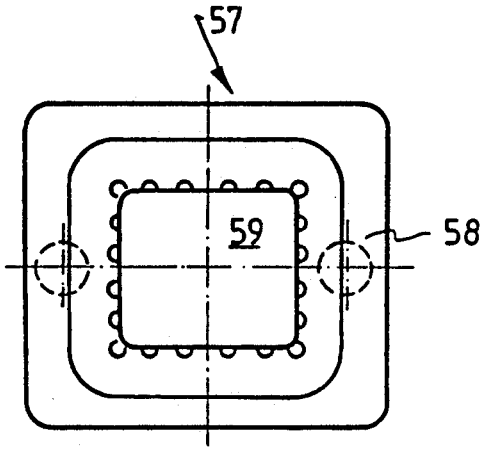
FIG. 19 is a plan view of the insert element illustrated in FIG. 18.
Figure 18:
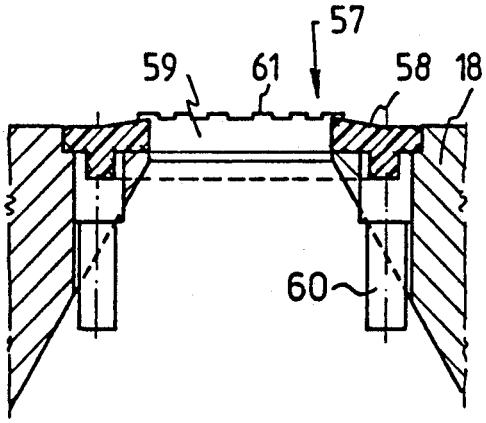
FIG. 18 is a sectional view of a part of a masking segment, with an insert element provided therein.

FIGS. 18 and 19 show in more detail a possible embodiment of an insert piece 57 to be provided at the outside of a masking segment 18. Such an insert piece 57 is preferably made of a soft material, e.g. silicone rubber having a hardness of 40–80, preferably 60° Shore. In the illustrated embodiment the insert piece is an at least substantially rectangular body 58 having a passage 59 centrally provided therein, which passage will determine the size of the dot-shaped coating eventually to be formed. A few projecting pins 60, being integral with the body 58, are provided on the body 58, said pins being received in correspondingly shaped holes provided in the masking segment, so as to firmly anchor the insert piece.

As is furthermore shown in FIGS. 18 and 19, projecting studs 61 are provided on the upper side of the insert piece 57 coming into contact with the band to be processed, in such a manner that the studs fill the cavities present in the basic components between parts of the basic components by deforming. The filling is made possible by the very accurate positioning of the band to be processed on the masking segments 18 and the insert pieces provided in the masking segments 18, so that the studs 61 will come to lie precisely opposite said cavities.

Figure 20:
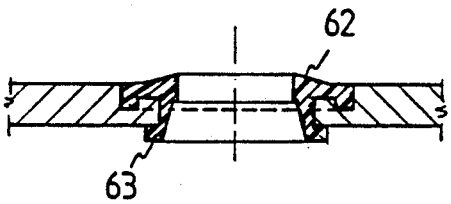
FIGS. 20 and 21 are sectional views of possible embodiments of further insert elements.

FIG. 20 shows an embodiment of an insert piece 62 which, at the side remote from the side that comes into contact with the band to be processed, is provided with a circumferential projecting collar 63, which extends under part of the masking segment only diagrammatically illustrated in FIG. 20, so that the insert piece 62 can be provided in the masking segment in a self-gripping manner.

Figure 21:
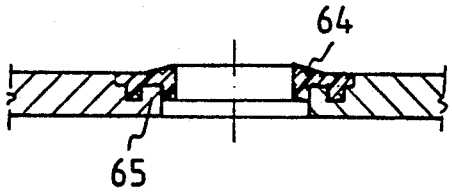

With the embodiment shown in FIG. 21 use is made of an insert piece 64, in whose bottom side a circumferential groove is provided, in which a correspondingly projecting edge 65 of the masking segment 18 engages. Near the projecting edge 65 the insert piece is glued to the masking segment 18.

We claim:

1. A device for applying dot-shaped coatings to metal or metallized bands by means of an electrolysis process or by means of currentless metal extraction, the device comprising:

a wheel-shaped guide means along which a metal or metallized band can be passed; and an endless masking means which co-operates with the band during operation and which is provided with passages whose shape is adapted to a desired dot-shaped coating;

wherein:

said masking means comprises independent masking segments which are each provided with at least one passage and which are coupled in a manner which permits movement of the masking segments with respect to each other in a longitudinal direction of the masking means;

each masking segment comprises a pin which during operation engages a recess provided in said band, such that each masking segment is fully adjustable with respect to said band;

the masking segments comprise inner boundary planes which are located at a side of the masking segments which is remote from outer boundary planes of the masking segments which support the band during operation, the inner boundary planes cooperating with a circular supporting surface of the wheel-shaped means such that a total length, as measured in a longitudinal direction of the masking means, of the inner boundary planes of the masking segments which constitute the masking means and cooperate with the circular supporting surface of the wheel-shaped means, is larger than a length of the circular supporting surface of the wheel-shaped means.

2. A device according to claim 1, wherein the masking segments are retained between two wheel-rings forming part of the wheel-shaped means.

3. A device according to claim 1 or 2, wherein a chamber is fixedly arranged within the wheel-shaped means, to whose interior a pressurized electrolyte can be supplied during operation, said chamber along part of its circumference being provided with slits, extending at least substantially parallel to the axis of rotation of the wheel-shaped means, for the discharge of electrolyte from the chamber.

4. A device according to claim 3, wherein near the outer boundary face making contact with the band to be processed, a passage provided in a masking means is surrounded by an insert piece consisting of a soft material.

5. A device according to claim 4, wherein the insert piece is provided with projecting studs.

6. A device according to claim 5, wherein successive masking segments are coupled by means of coupling plates, which are pivotally coupled to the masking segments by means of pins, whereby at least one of said pins is located, along part of its length, in a recess having a larger diameter than said at least one pin.

7. A device according to claim 6, wherein a sealing means made of a flexible material is provided between two successive masking segments.

8. A device according to claim 7, wherein said sealing means comprises a U-shaped part with two legs extending at least substantially parallel to each other, said legs being located in recesses provided in the facing sides of the masking segments, in such a manner that the free ends of said legs are directed towards the axis of rotation of the wheel-shaped means.

9. A device according to claim 7, wherein said sealing means, provided between two successive masking segments, seals a gap between the masking segments, and also couples the masking segments in such a manner, that said masking segments can move with respect to each other in the longitudinal direction of the masking means.

10. A band or a component detached from a band, on which one or more dot-shaped coatings are provided by using the device according to claim 9.

* * * * *

UNITED STATES PATENT AND TRADEMARK OFFICE

CERTIFICATE OF CORRECTION

PATENT NO. : 5,282,945

DATED : February 1, 1994

INVENTOR(S) : Jörg W. RISCHKE, et al.

It is certified that error appears in the above-indentified patent and that said Letters Patent is hereby corrected as shown below:

On the title page, Items [19] and [75], the first inventor's last name should read:

[19] --Rischke et al.--

[75] --Jörg W. Rischke,--

Signed and Sealed this

Thirty-first Day of May, 1994

Bruce Lehman

*Attest:*

BRUCE LEHMAN

*Attesting Officer*

*Commissioner of Patents and Trademarks*